US010074496B2

(12) United States Patent
Lamara et al.

(10) Patent No.: US 10,074,496 B2
(45) Date of Patent: Sep. 11, 2018

(54) CIRCUIT INTERRUPTING DEVICE

(71) Applicant: SECHERON SA, Satigny (CH)

(72) Inventors: Tarek Lamara, Confignon (CH); Bjorn Fischer, Luins (CH); Claudio Tricarico, Nyon (CH)

(73) Assignee: SECHERON SA, Satigny (CH)

( * ) Notice: Subject to any disclaimer, the term of this patent is extended or adjusted under 35 U.S.C. 154(b) by 0 days.

(21) Appl. No.: 15/126,377

(22) PCT Filed: Mar. 12, 2015

(86) PCT No.: PCT/IB2015/051809
§ 371 (c)(1),
(2) Date: Sep. 15, 2016

(87) PCT Pub. No.: WO2015/140674
PCT Pub. Date: Sep. 24, 2015

(65) Prior Publication Data

US 2017/0084411 A1 Mar. 23, 2017

(30) Foreign Application Priority Data

Mar. 17, 2014 (EP) ..... 14160204

(51) Int. Cl.
*H01H 33/662* (2006.01)

(52) U.S. Cl.
CPC ..... *H01H 33/66207* (2013.01); *H01H 2033/66223* (2013.01)

(58) Field of Classification Search
CPC ..... H01H 33/66207; H01H 33/66215; H01H 33/6623; H01H 33/662
USPC ..... 218/139, 118, 134, 10
See application file for complete search history.

(56) References Cited

U.S. PATENT DOCUMENTS 3,597,558 A * 8/1971 Gotsch ..... H01H 33/66207 174/17.05
3,694,601 A * 9/1972 Atkinson ..... H01H 33/66207 218/134
8,178,812 B2 5/2012 Martin et al.

FOREIGN PATENT DOCUMENTS

| | | | |
|---|---|---|---|
| DE | 36 28 174 | A1 | 2/1988 |
| JP | 56-86419 | A | 7/1981 |
| JP | 2003 031090 | A | 1/2003 |
| WO | 2010/000769 | A1 | 1/2010 |
| WO | 2012/042294 | A1 | 4/2012 |

OTHER PUBLICATIONS

Translation DE3628174 (Original doc. published Feb. 25, 1988).*
Translation JPS 5856444 (Orig. doc. published Jul. 14, 1981).*
Translation WO2010000769 (Orig. doc. published Jan. 7, 2010).*
(Continued)

*Primary Examiner* — Renee S Luebke
*Assistant Examiner* — William Bolton
(74) *Attorney, Agent, or Firm* — Young & Thompson

(57) ABSTRACT

A vacuum interrupter (1) includes a tubular insulating case (3, 4) extending along a longitudinal axis (AA), two conducting caps (51, 52) each securely fixed at an open end of the tubular insulating case (3, 4) at a sealing area (7) to form a tightly sealed chamber (2). The vacuum interrupter is characterized in that the tubular insulating case (3, 4) is shaped so as to enclose the conducting caps (51, 52) and extend beyond the caps (51, 52) along its longitudinal axis (AA).

5 Claims, 10 Drawing Sheets

(56) References Cited

OTHER PUBLICATIONS

Translation JP2003-031090 (Orig. doc. published Jan. 31, 2003).*
European Search Report issued in Application No. 14 16 0204, dated Aug. 29, 2014.
International Search Report, dated Jun. 22, 2015, from corresponding PCT application.

* cited by examiner

CIRCUIT INTERRUPTING DEVICE

BACKGROUND OF THE INVENTION

Field of the Invention

The present invention relates to a circuit interrupting device used for current breaking or switching and more particularly to a vacuum interrupter for high or medium voltage application.

Description of the Related Art

Vacuum interrupters generally comprise an extinguishing chamber in which a low pressure prevails. The chamber is formed by an insulating case, sometimes also called housing or bottle, usually made from one or more cylinders made of ceramic or glass-ceramic, which constitute a generally tubular first central part. Typical ceramics used for vacuum interrupter are manufactured mainly from alumina ($Al_2O_3$) and a small percentage of silica ($SiO_2$) up to about 6%. This insulating case is sealed off at its ends by caps, usually made from metal. The metal caps are usually brazed to the ceramic insulating case to form a vacuum tight joint seal, using an active braze material or after a well-controlled metallization step on the end surfaces of the ceramic part(s).

A pair of contacts is located in the extinguishing chamber. These contacts are able to move between a closed position in which the electric current can flow and an open position in which the two contacts are separated so as to interrupt the current flow. Usually, one contact is stationary, fixed in a secured manner to one of the caps sealing the chamber, and the other contact is movable within the chamber. A bellows surrounds the movable contact and enables the inside of the chamber to be mechanically sealed and airtight so as to remain at a low pressure.

The use of ceramic or glass-ceramic for the insulating case is ideal for vacuum interrupters because of its mechanical strength, its low porosity, its low out-gassing, its ability to form vacuum tight seals and its excellent high-voltage withstand characteristics. Moreover, ceramics (or glass-ceramic) present also a high resistance to environmental conditions, such as pollution or $O_3$ corrosion.

Much work has been done on the internal design of the vacuum interrupter (shape, geometry and material of contacts, shield, insulating cylinders) in order to ensure proper dielectric characteristics of the said interrupter when contacts are separated to reach adequate performance in switching or breaking a current.

Vacuum interrupters must also exhibit a high enough dielectric strength externally to withstand the high voltage applied between the interrupter open contacts (terminals). A free air space around the interrupter may not be sufficient, in particular when the operating voltage is medium or high. To fulfil the dielectric requirement in routine high voltage tests (BIL and power frequency test), one option is to locate the vacuum interrupter in a dielectric environment such as a tightly sealed enclosure containing a dielectric fluid, like $SF_6$ or oil or even pressurised air. However, these solutions are cumbersome to implement and to manage while in use. In particular, while insulating gas could be suitable for use in fixed indoor substations, it is not quite so on the outdoor rolling stock where exposure to harsh environment conditions could lead to breakage of the sealed enclosure and leaking of the gas.

Another option to ensure proper external insulation of the vacuum interrupter can be realised by casting or coating of the vacuum interrupter with a suitable encapsulating material such as silicone rubber, epoxy or other suitable polymer. A bonding agent can be used between the ceramic of the main part of the interrupter and the insulating material for proper adhesion. However, on one hand, the ceramic part(s), the metal caps and the polymer coating present each different thermal expansion coefficient which can cause cracking, or even breaking of the insulating enclosure. On the other end, epoxy and other polymer do not age well and are sensitive to harsh environment condition such as pollution or $O_3$ corrosion.

U.S. Pat. No. 8,178,812 discloses a vacuum interrupter in which external insulation is achieved by an insert moulding step involving high-pressure injection of an elastomer that is vulcanized. Before being placed in the injection mould, the device is assembled with protective cover-plates that cover the fragile areas. In particular, the cover-plates made from conductive thermoplastic or thermosetting material are fitted onto the caps of the interrupter and extend beyond the junction area between insulating (ceramic parts) and conducting elements (metal parts). The shape of the cover-plates is further optimized to act as mechanical strengtheners. This solution is not very compact and requires the pre-assembling of cover-plates before covering the interrupter with a rigid elastomer enclosure. Besides, it still presents the above-mentioned drawbacks of using sensitive elastomer.

To provide for a more compact solution, WO 2012/042294 discloses a vacuum interrupter with selective external encapsulation: external encapsulation is provided for at least one contact terminal or electrode extending from the metallic end cap of the corresponding said contacts and covering the ceramic part by an overlapping distance (around 12 to 18 mm). The encapsulating material is a solid insulation such as silicone rubber. Although, this solution is compact, easier to implement, more versatile and less costly, it is less efficient for some outdoor applications for the reasons cited above with respect to the resistance to extreme atmospheric conditions of polymers.

Similarly, WO 2010/000769 discloses a vacuum switching tube comprising a housing with at least one ceramic housing section and metal housing parts, wherein transition areas between the at least one ceramic housing section and the metal housing parts are covered by way of an insulating material. The insulating layer is made of an insulating material such as a polymer resin or a thermoplastic and additives that influence the insulating properties of the insulating material. JP 2003 031090 discloses another example of a vacuum switching tube comprising a rubber layer at the junction of the insulating cylinders and the end plates of the tube. As with the solution of WO 2012/042294, these two examples of vacuum switching interrupter are not made to withstand outdoor atmospheric conditions due to the use of polymer or rubber.

BRIEF SUMMARY OF THE INVENTION

Owing to the above, there is a need for a vacuum interrupter with a better external dielectric strength without additional cumbersome and unreliable encapsulation. The aim of the invention is therefore to provide a vacuum interrupter that is compact, reliable and that can be used both in indoor or in outdoor situations where atmospheric and environment conditions are harsh.

The object of the present invention is a vacuum interrupter as disclosed below.

BRIEF DESCRIPTION OF THE DRAWINGS

Other advantages and features of the invention will become more clearly apparent from the following description of particular embodiments of the invention given as non-restrictive examples only and represented in the accompanying drawings.

DETAILED DESCRIPTION OF THE PREFERRED EMBODIMENTS

Figure 1A:
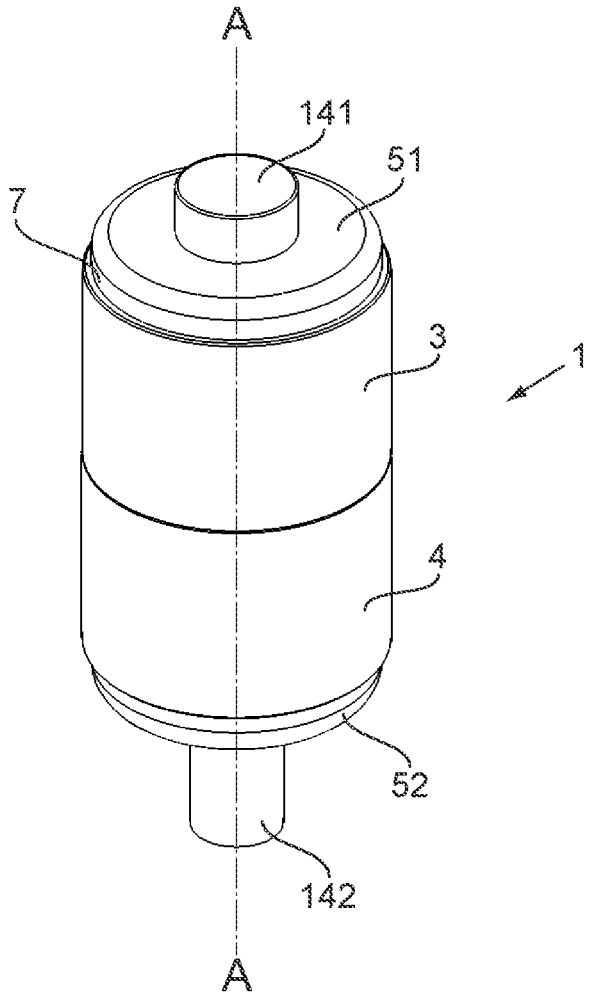
FIG. 1*a* illustrates a conventional vacuum interrupter without external encapsulation.

Although the essential feature of the invention concerns the external design of a vacuum interrupter, such an interrupter will be first briefly described for the sake of clarity and completeness.

A vacuum interrupter 1 according to the invention is designed for use in a circuit-breaking device to perform switching and/or breaking in an electric circuit. The vacuum interrupter 1 according to the invention is preferably arranged to operate at high or medium voltage.

The vacuum interrupter 1 generally comprises a sealed extinguishing chamber 2 in which a controlled low pressure of air or another dielectric fluid preferably prevails, i.e. a vacuum. The chamber 2 is defined by a tubular insulating case. In the illustrated vacuum interrupter 1, the tubular insulating case is preferably formed by two insulating cylinders 3, 4 made from ceramic or glass-ceramic.

A conducting cap 51, 52 closes each open end of the chamber 2. Preferably, the caps 51, 52 are made of metal and each comprises a substantially flat base-plate essentially perpendicular to the longitudinal axis AA of the interrupter 1 and extended on its periphery by an essentially orthogonal sidewall 61, 62.

The conducting caps 51, 52 are secured in a tightly sealed manner to their corresponding ceramic cylinders 3, 4 in a sealing area 7. The sealing area 7 is limited to a line that corresponds to a braze of the peripheral wall 61, 62 of the caps 51, 52 on their respective ceramic cylinders 3, 4. Obviously, any other known technique can be used to effectively seal the caps 51, 52 to their respective ceramic cylinders 3, 4.

The chamber 2 bounded by the ceramic cylinders 3, 4 and caps 51, 52 comprises a pair of acting contacts 101, 102 that are movable with respect to one another along the longitudinal axis AA of the vacuum interrupter 1. Each contact 101, 102 comprises a contact pad 121, 122 made from suitable material fixed onto a longitudinal electrode 141, 142.

Preferably, as illustrated, a first contact 101 is stationary and securely fixed to one of the end caps 51 to which its electrode 141 is coupled, for example by welding, brazing or mechanical assembly. The second contact 102 is mounted inside the chamber 2 with its electrode 142 so as to be able to move through the other cap 52. To enable the movable contact 102 to move and to maintain the controlled vacuum inside chamber 2, a sealing metallic bellows 16 is fitted between the movable electrode 142, to which it can for example be welded at one end, and the corresponding cap 52, thereby sealing the opening of the cap 52 of the chamber 2. A metallic bellows shield 18 can be fitted around the sealing bellows 16, at the level of the end thereof coupled to the electrode 142, to protect the said bellows 16 against projections caused by the arc during a current interruption process.

The tightly sealed chamber 2 preferably further comprises a metallic shield 20 positioned at the level of the contact pads 121, 122 whatever the position thereof in order to protect the insulating ceramic cylinders 3, 4 against metallic vapour or any projections that might occur during arcing. In the shown embodiment, the metallic shield 20 is held between the two ceramic cylinders 3, 4 and secured to said cylinders by brazing or any other suitable means ensuring proper sealing. In an alternative, if the tubular insulating case is made in one piece for example, the metallic shield 20 could be secured in a fixed manner to one of the caps 51, 52.

A vacuum interrupter 1 as described above is pictured for example in FIGS. 1*a* to 1*c*. It is well known to the person of ordinary skills in the art and has been described as an example only. The internal components of the interrupter (contacts 101, 102, cylinders 3, 4, caps 51, 52, shields 18, 20) are designed to optimize the thermal and dielectric properties and the mechanical strength of the interrupter 1. These internal design features are well known to the person of ordinary skills in the art and will not be described in further detail.

Without any further external additional insulation or encapsulation of the vacuum interrupter, an electric breakdown might occur between the caps 51, 52, on the exterior of the interrupter when said interrupter is stressed by high-voltage surge and the contacts 101, 102 are open.

To prevent such dielectric failure, it is known to encapsulate the interrupter in a sealed case containing a dielectric fluid/gas or to coat (embed) all or part of it in a suitable polymer like silicon rubber or epoxy. As previously mentioned, those solutions present some drawbacks.

According to the invention, the tubular insulating case is extended on its outside part so as to surround and enclose the caps 51, 52 without changing the dimension and the components of the vacuum interrupter. Hence, external dielectric performances of the vacuum interrupter are improved.

Generally, the insulating tubular case of the vacuum interrupter 1 according to the present invention is designed to surround and enclose the caps 51, 52. In particular, the tubular insulating case extends along the sidewall 61, 62 of said conducting caps 51, 52. Hence, since ceramic or glass-ceramic is an insulating material, the external insulating distance between the caps 51, 52 is increased and thus the dielectric performance of the interrupter is enhanced.

Figure 2A:
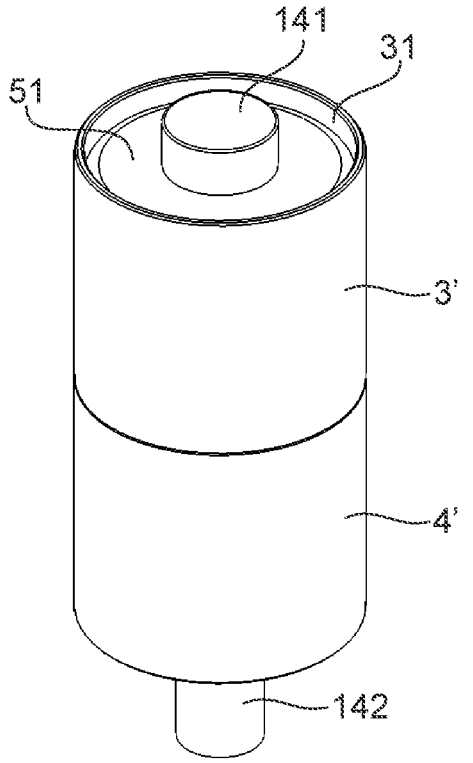
FIG. 2*a* illustrates a vacuum interrupter according to a first embodiment of the invention.
Figure 2B:
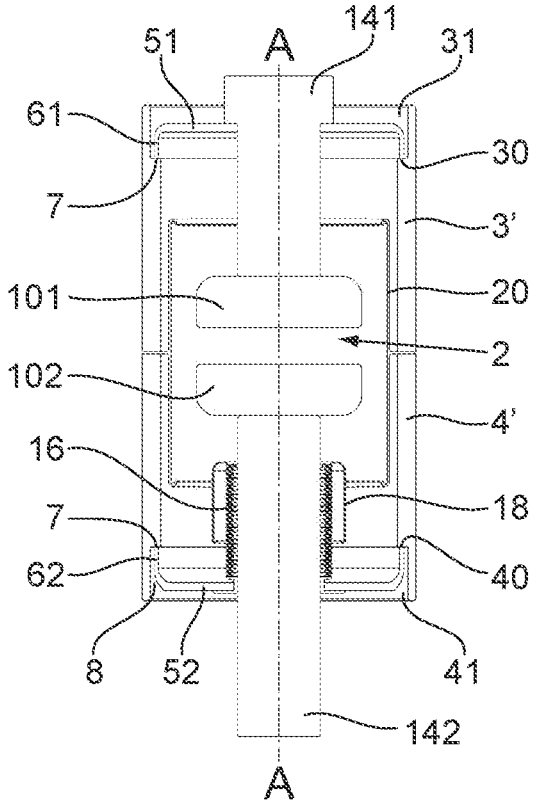
FIGS. 2*b* and 2*c* are cross section of the vacuum interrupter illustrated in FIG. 2*a*.
Figure 2C:
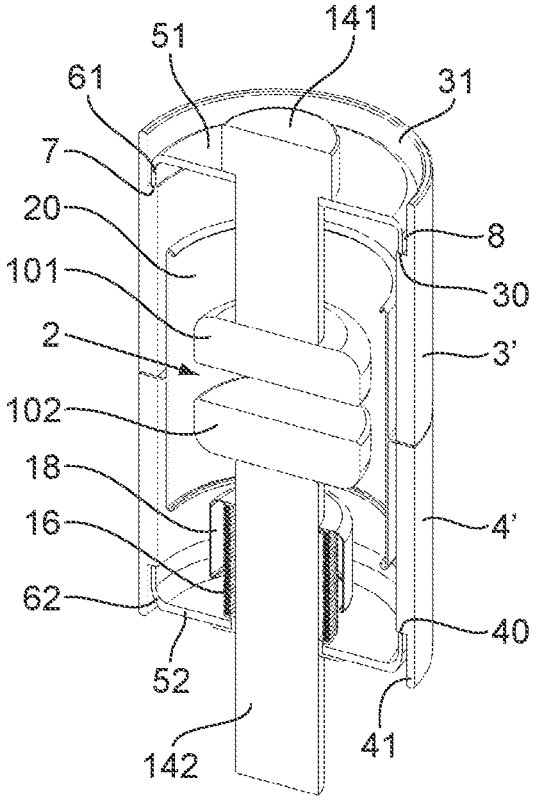

In a first embodiment illustrated in FIGS. 2*a* and 2*b*, the ceramic cylinders 3', 4' forming the tubular insulating case are each made in one piece so that they each extend beyond their respective caps 51, 52 and in particular along the sidewall 61, 62 of said caps. The said caps 51, 52 are then wholly enclosed by said cylinders 3', 4' (FIG. 2*b*). In this first embodiment, the extension portions 31, 41 of the cylinders 3', 4' surrounding the sidewall 61, 62 of the caps 51, 52 have a smaller thickness than the rest of the cylinders 3', 4'. The cylinders 3', 4' further comprise an inner flange 30, 40 which corresponds to the sealing area 7 and on which the walls 61, 62 of the caps 51, 52 are brazed or suitably sealed. The extension portions 31, 41 may extend from this flange 30, 40 to surround the caps 51, 52.

Figure 2D:
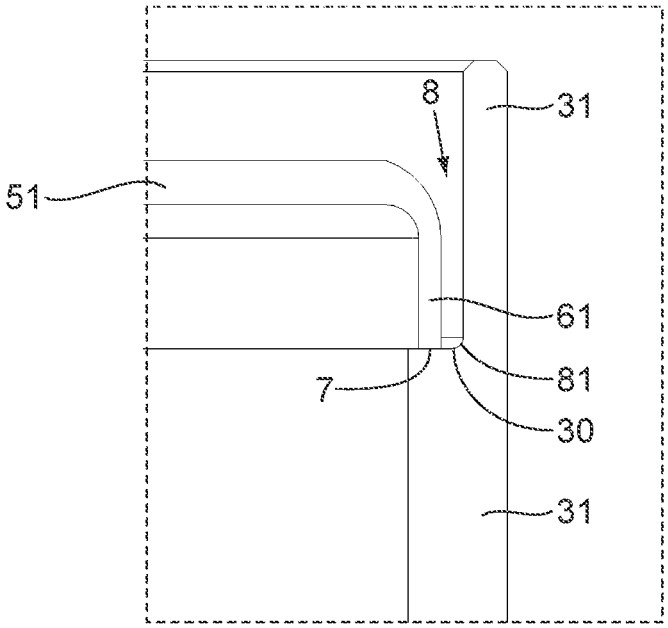
FIGS. 2*d* and 2*e* are enlarged views of a portion of the vacuum interrupter illustrated in FIGS. 2*a* to 2*c*.
Figure 2E:
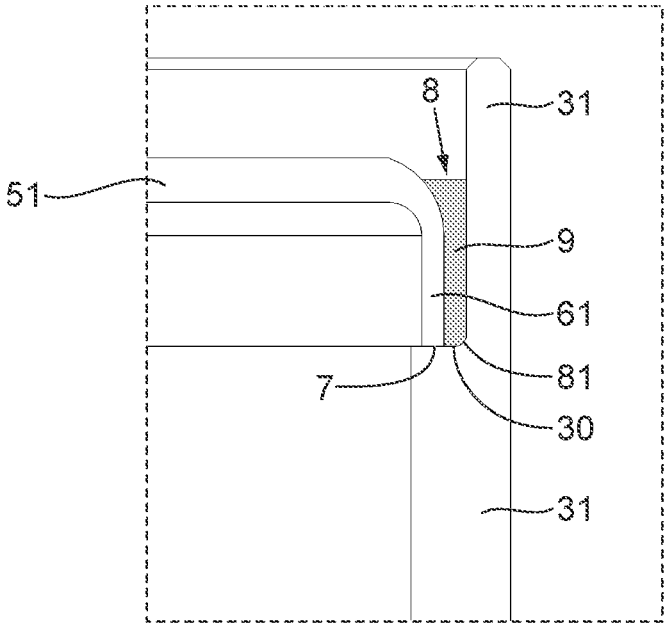

FIG. 2*d* is an enlarged view of the gap 8 between the metal caps 51, 52 and the extension portions 31, 41 of the cylinders 3', 4'. In a variant illustrated on FIG. 2*e*, the gap 8 between the metal caps 51, 52 and the extension portions 31, 41 of the cylinders 3', 4' can be filled with a suitable filling resin 9 to supress the sharp corner and reduce the electric field enhancement. Preferably, the said filling resin 9 is an epoxy-resin or rubber (silicone rubber, polyurethane . . . ) or a suitable semi-conductive resin. More preferably, for a better distribution of the electric potential lines, the said filling resin 9 is a metal-filled or ceramic- (micro- or nano-powder) filled epoxy ($Al_2O_3$-filled epoxy, $TiO_2$-filled epoxy or $SiO_2$-filled epoxy composites, for example).

Preferably, the angle 81 at the bottom of the gap 8, defined as the angle between the inner flange 30, 40 and the inner walls of the extension portion 31, 41, is not sharp but rather rounded as illustrated in the FIGS. 2*d* an 2*e*. This is to reduce the electric field enhancement.

Figure 3A:
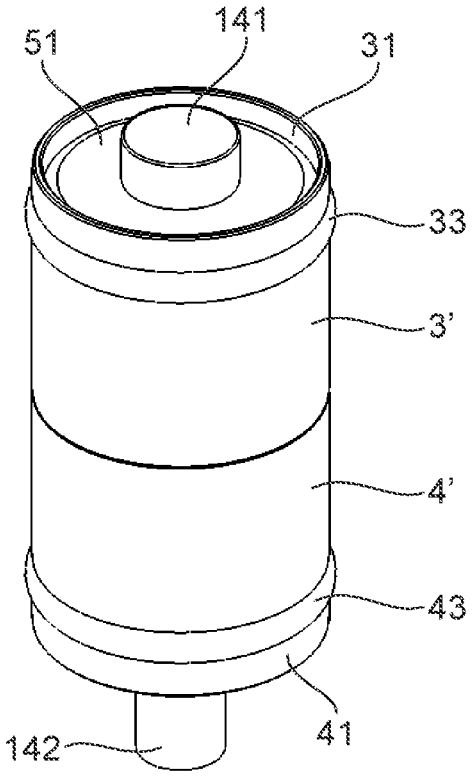
FIGS. 3*a* and 3*b* illustrate a vacuum interrupter according to a first variant of the first embodiment of the invention.
Figure 3B:
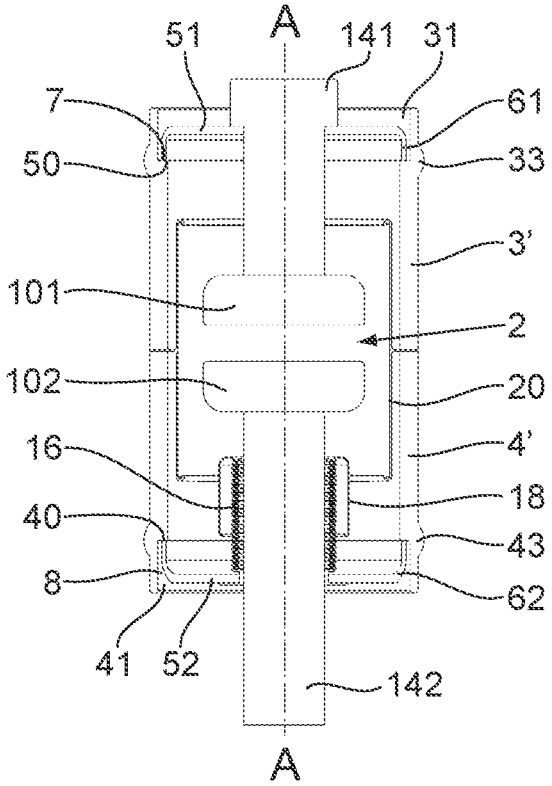

In the first embodiment illustrated on FIGS. 2*a* to 2*d*, the cylinders 3', 4' present the same external diameter along their length. FIGS. 3*a* and 3*b* illustrate a variant in which the cylinders 3', 4' each present a portion with a larger external diameter forming a bulge 33, 43 near the sealing area 7 and the flanges 30, 40. This has for effect to diverge further the electric potential lines close to the sealing (brazing) area 7 (metal-ceramic edges).

Figure 4A:
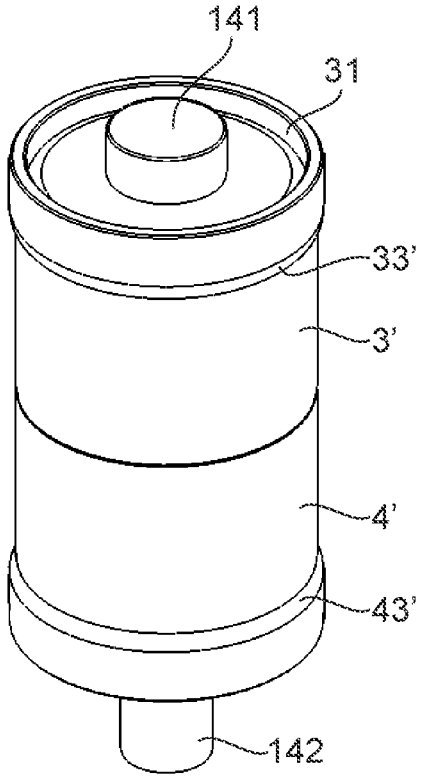
FIGS. 4*a* and 4*b* illustrate a vacuum interrupter according to a second variant of the first embodiment of the invention.
Figure 4B:
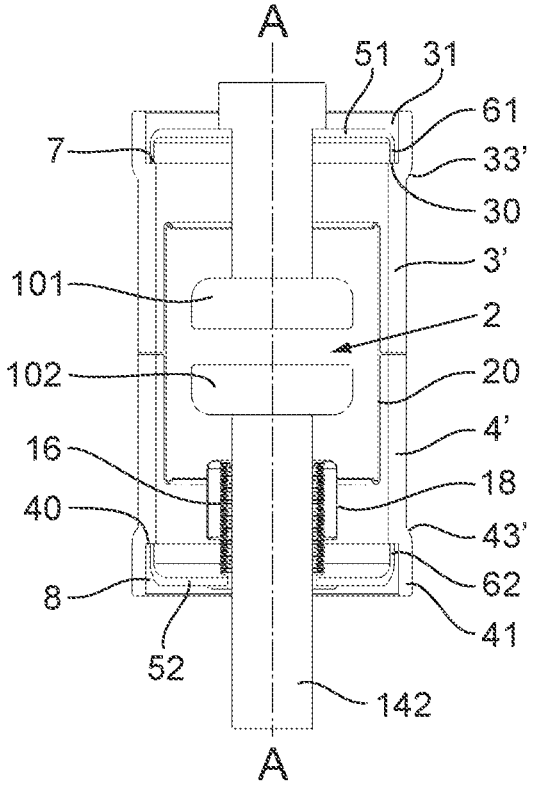
Figure 5A:
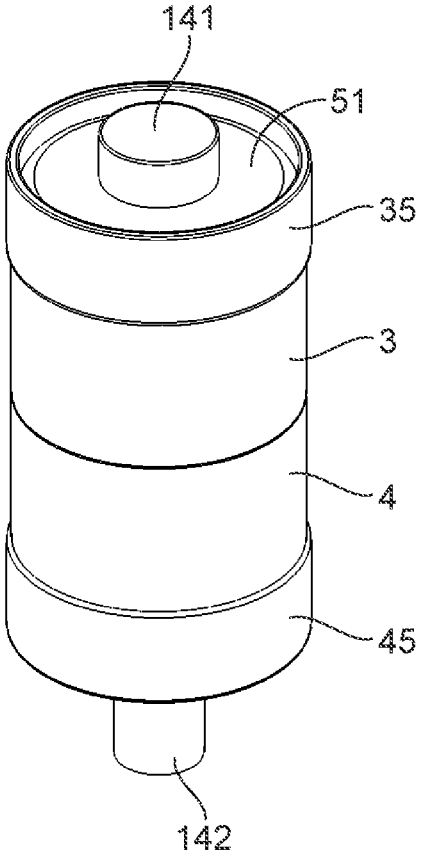
FIG. 5*a* illustrates a vacuum interrupter according to a second embodiment of the invention.
Figure 5B:
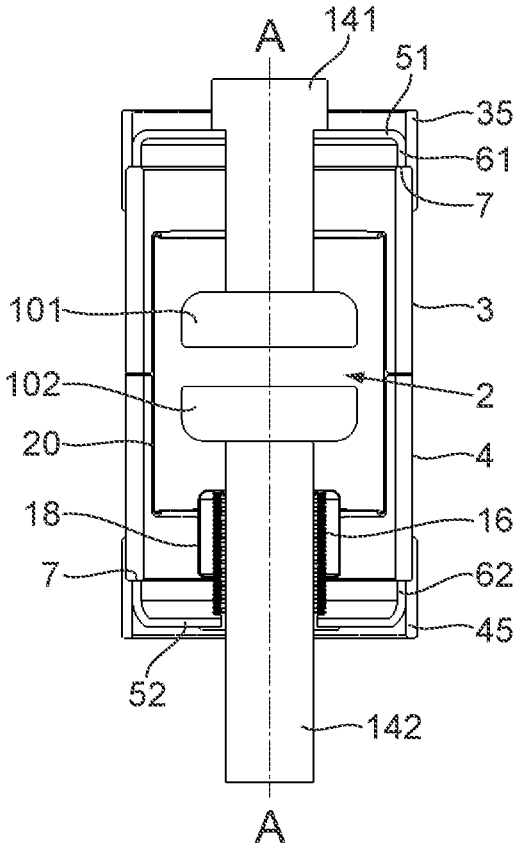
FIGS. 5*b* and 5*c* are cross section of the vacuum interrupter illustrated in FIG. 5*a*.
Figure 5C:
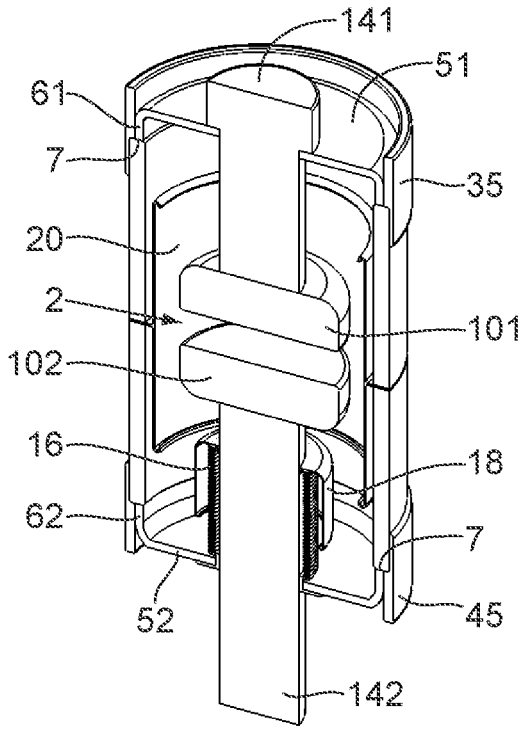

In another variant shown in FIGS. 4*a* to 4*b*, the extension portions 31, 41 of the cylinders 3', 4' surrounding the caps 51, 52 present a thickness essentially equal to the thickness of the rest of the cylinders 3', 4'. The said portions 31', 41' have an internal and external diameters greater than the rest of the cylinders 3', 4' which result in a shoulder 33', 43' being formed on the external part of the cylinders 3', 4' opposite the inner flanges 30, 40 and the sealing areas 7. This specific variant presents the same effect as obtained by the bulge 33, 43, and moreover brings additional mechanical strength to the extension portion 31', 41'.

Figure 1B:
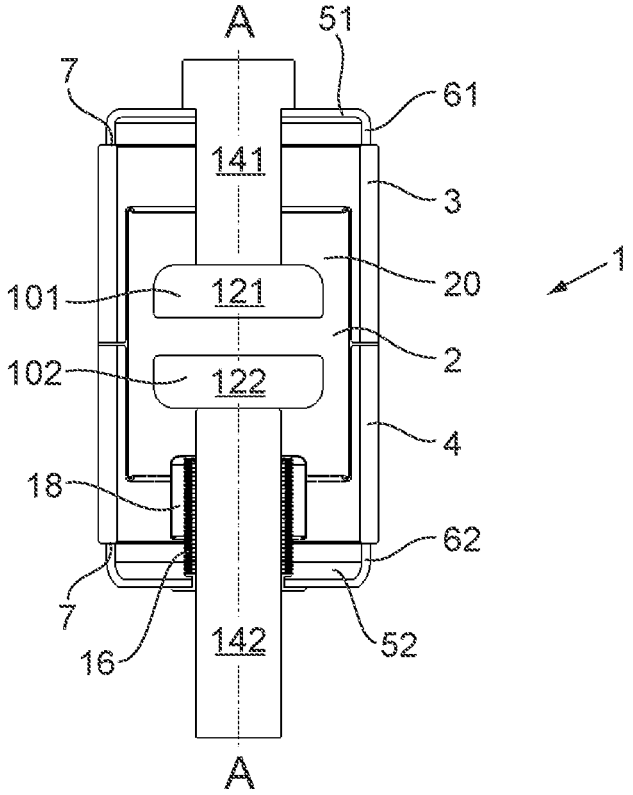
FIGS. 1*b* and 1*c* are cross sections of the vacuum interrupter illustrated in FIG. 1*a*.
Figure 1C:
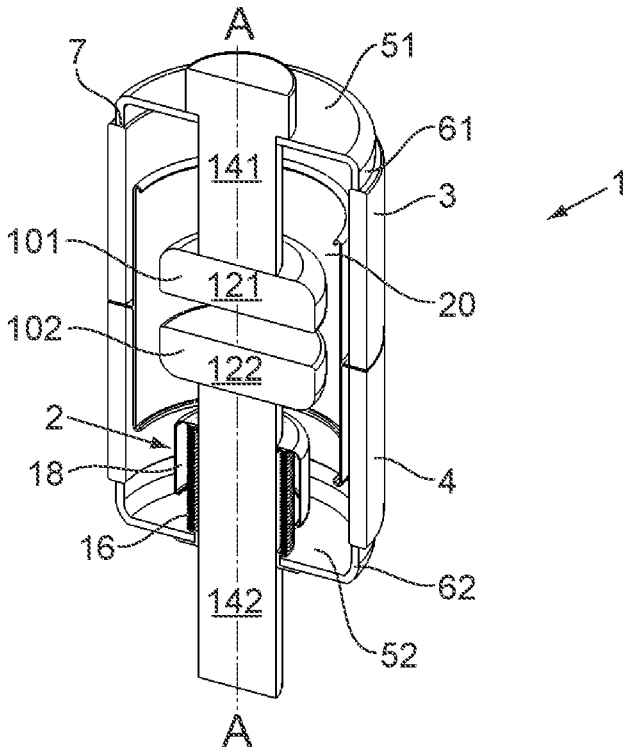

FIGS. 5*a* to 6*b* illustrate a second embodiment of a vacuum interrupter according to the invention. This particular embodiment aims to apply the essential principle of the invention to existing standard ceramic or glass-ceramic vacuum interrupters (i.e. such as shown in FIGS. 1*a* to 1*c*).

According to this second embodiment, the tubular insulating case is extended to surround the caps 51, 52 by affixing extension portions 35, 45 to the cylinders 3, 4. The said extension portions 35, 45 are essentially tubular in shape and made of ceramic or glass-ceramic. The extension portions 35, 45 are conformed to overlap part of their respective cylinders 3, 4 (see FIG. 5*b*) and to wholly surround the caps 51, 52 and extend along the sidewalls 61, 62 of said caps 51, 52. The extension portions 35, 45 are tightly fixed or glued to their respective cylinders 3, 4 by any suitable means. The gluing material can be an epoxy or metal-filled epoxy adhesive suitable for ceramic bonding. For high voltage applications (requiring high dielectric strength), the adhesive is preferably a polymer composite adhesive such as ceramic micro- or nano-powder filled epoxy ($Al_2O_3$-filled epoxy, $TiO_2$-filled epoxy or $SiO_2$-filled epoxy composites, for example). The advantages of these epoxy-filled composite is their higher dielectric constant $e_r$ (relative permittivity) than epoxy ($e_r$~6 for the composite instead of $e_r$~3.5 for epoxy).

Figure 6A:
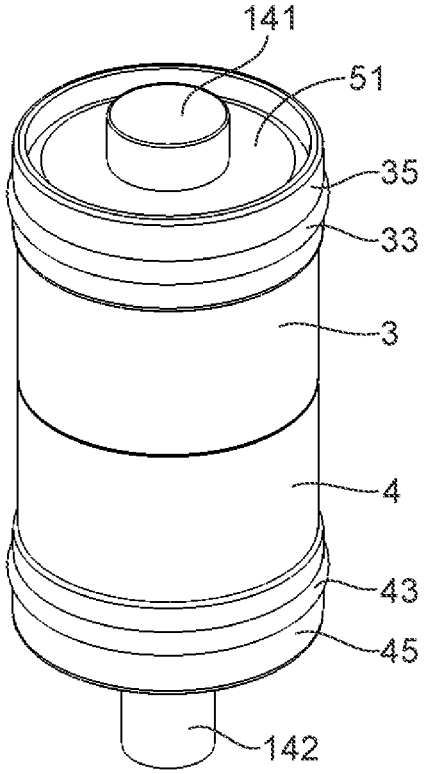
FIGS. 6*a* and 6*b* illustrate a vacuum interrupter according to a variant of the second embodiment of the invention.
Figure 6B:
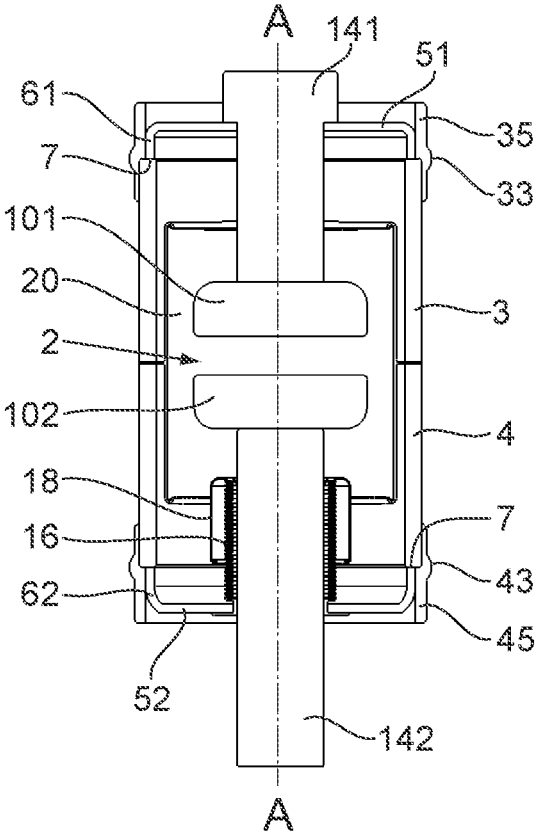

Like for the first embodiment, in a variant shown in FIGS. 6*a* and 6*b*, the extension portions 35, 45 present each a portion of larger thickness forming a bulge 33, 43 near the sealing area 7 where the caps 51, 52 are brazed onto the cylinders 3, 4.

In a similar fashion, the gap between the metal caps 51, 52 and the extension portions 35, 45 of the cylinders 3, 4 can be filled with a suitable filling resin such as described above with respect to the first embodiment.

Hence, with this second embodiment, it is possible to outfit prior art vacuum interrupters that would previously have to be encapsulated to ensure external dielectric performances without modifying the existing design of said prior art vacuum interrupters.

The invention presents the following advantages:

- The external insulation and dielectric performances of the vacuum interrupter are improved without the need to make big changes to its standard well-known design; there is in particular no need to modify the inner dimensions and setting of the vacuum interrupter.
- There is no need to seal the vacuum interrupter in an external encapsulation medium like $SF_6$, oil or pressurised air which leads to cumbersome devices and are not practical for outdoor uses;
- There is no need for whole or partial additional encapsulation with solid insulator like epoxy, silicone rubber or any other suitable polymer that do not age well in harsh atmospheric conditions;
- Ceramic components provide a good insulation and have a good resistance to environmental conditions especially to ozone formation, ensuring a long life of the whole interrupter.

The above embodiments have been described as examples. Some modifications or variations in the invention are construed to be within the scope if the invention.

The invention claimed is:

1. A vacuum interrupter (1) comprising:

a tubular insulating case (3', 4') extending along a longitudinal axis (AA); and two conducting caps (51, 52) each securely fixed at an open end of the tubular insulating case (3', 4') at a sealing area (7) to form a tightly sealed chamber (2), wherein the tubular insulating case (3', 4') comprises two extension portions (31, 41) made of insulating material and each essentially extending from the sealing area (7) along the longitudinal axis (AA) beyond a corresponding one of the two conductive caps (51, 52) to wholly enclose and surround said corresponding conductive cap (51, 52), wherein the extension portions (31, 41) are made in one piece with the tubular insulating case (3', 4'), and wherein the tubular insulating case is formed by two insulating cylinders (3', 4') which comprise each an inner flange (30, 40) which corresponds to the sealing area (7) and on which walls (61, 62) of the caps 51, 52 are brazed or suitably sealed; and an angle (81) between the inner flange (30, 40) and walls of the extension portion (31, 41) is rounded.

2. A vacuum interrupter (1) comprising:

a tubular insulating case (3, 4) extending along a longitudinal axis (AA); and two conducting caps (51, 52) each securely fixed at an open end of the tubular insulating case (3, 4) at a sealing area (7) to form a tightly sealed chamber (2), the tubular insulating case (3, 4) being made of ceramic or glass-ceramic, and comprising two extension portions (35, 45) made of ceramic or glass-ceramic, wherein the two extension portions (35, 45) are securely affixed to the tubular insulating case and overlap part of the tubular insulating case near the sealing area (7), wherein the two extension portions (35, 45) each extend essentially from the sealing area (7) along the longitudinal axis (AA) beyond a corresponding one of the conductive caps (51, 52) to wholly enclose and surround said corresponding conductive cap (51, 52), and wherein the tubular insulating case is formed by two insulating cylinders (3', 4') which comprise each an inner flange (30, 40) which corresponds to the sealing area (7) and on which walls (61, 62) of the caps 51, 52 are brazed or suitably sealed; and an angle (81) between the inner flange (30, 40) and walls of the extension portion (31, 41) is rounded.

3. The vacuum interrupter (1) according to claim 2, wherein there is a gap (8) between the conductive caps (51, 52) and the extension portions of the tubular insulating case.

4. The vacuum interrupter (1) according to claim 3, wherein the gap (8) is filled with a filling resin (9).

5. The vacuum interrupter (1) according to claim 4, wherein said filling resin (9) is either an epoxy-resin or rubber or a semi-conductive resin or ceramic- or metal-filled epoxy resin.

* * * * *